US007827030B2

(12) United States Patent
Smith et al.

(10) Patent No.: US 7,827,030 B2
(45) Date of Patent: Nov. 2, 2010

(54) ERROR MANAGEMENT IN AN AUDIO PROCESSING SYSTEM

(75) Inventors: Gregory Ray Smith, Bellevue, WA (US); David Russo, Woodinville, WA (US)

(73) Assignee: Microsoft Corporation, Redmond, WA (US)

( * ) Notice: Subject to any disclaimer, the term of this patent is extended or adjusted under 35 U.S.C. 154(b) by 731 days.

(21) Appl. No.: 11/763,928

(22) Filed: Jun. 15, 2007

(65) Prior Publication Data

US 2008/0312932 A1 Dec. 18, 2008

(51) Int. Cl.
*G10L 21/02* (2006.01)

(52) U.S. Cl. ..... 704/228; 704/270

(58) Field of Classification Search ..... 704/226–228, 704/221–223, 270
See application file for complete search history.

(56) References Cited

U.S. PATENT DOCUMENTS

| | | | | |
|---|---|---|---|---|
| 4,630,305 | A | 12/1986 | Borth et al. | 381/94 |
| 5,255,343 | A * | 10/1993 | Su | 704/242 |
| 5,309,443 | A * | 5/1994 | Schorman | 714/708 |
| 5,537,509 | A * | 7/1996 | Swaminathan et al. | 704/228 |
| 5,809,460 | A | 9/1998 | Hayata et al. | 704/225 |
| 5,897,613 | A | 4/1999 | Chan | 704/210 |
| 6,144,936 | A * | 11/2000 | Jarvinen et al. | 704/226 |
| 6,549,886 | B1 | 4/2003 | Partalo | 704/270.1 |
| 7,013,271 | B2 | 3/2006 | Nayak | 704/226 |
| 7,127,399 | B2 | 10/2006 | Hama et al. | 704/270.1 |
| 7,181,027 | B1 | 2/2007 | Shaffer et al. | 381/94.1 |
| 2003/0212550 | A1 | 11/2003 | Ubale | 704/215 |
| 2003/0216178 | A1 * | 11/2003 | Danieli et al. | 463/35 |
| 2005/0111371 | A1 | 5/2005 | Miura et al. | 370/242 |
| 2006/0034340 | A1 | 2/2006 | Rong et al. | 370/521 |
| 2007/0036176 | A1 | 2/2007 | Quigley et al. | 370/468 |

OTHER PUBLICATIONS

Bourget, F., "In Packet Voice Networks, Call Quality is more than Voice Clarity", *CompactPCI Systems*, Jul./Aug. 2004, http://www.octasic.com/en/news, 4 pages.

Dempsey, B.J. et al., "On Retransmission-Based Error Control for Continuous Media Traffic in Packet-Switching Networks", http://historical.ncstrl.org, 24 pages.

"Voice Enhancement for Conferencing Services", Ditech Networks, © 2006-2007, http://www.ditechnetworks.com/solutions, 4 pages.

* cited by examiner

*Primary Examiner*—Abul Azad
(74) *Attorney, Agent, or Firm*—Woodcock Washburn LLP

(57) ABSTRACT

An audio processing system includes a voice decoder and an audio processor. In one exemplary embodiment, the audio processing system is embedded in a headset unit that is wirelessly coupled to a game console. The voice decoder is used to decode a stream of incoming voice data packets carried over a wireless signal. The decoded voice data packets are used to drive an audio transducer of the headset unit. Upon detection of an error in the incoming stream, a decoded error-free voice data packet that has been stored in a replay buffer is used to generate an amplitude scaled audio signal. The voice decoder is disconnected from the audio transducer and the scaled audio signal is used to drive the audio transducer instead.

15 Claims, 7 Drawing Sheets

ERROR MANAGEMENT IN AN AUDIO PROCESSING SYSTEM

TECHNICAL FIELD

The technical field generally relates audio processing systems and more specifically relates to processing of voice data packets carried in a wireless signal from a game console to a headset unit.

BACKGROUND

Wireless signals are often susceptible to radio frequency interference (RFI), which leads to corruption of data being carried in the wireless signal. In one application, the data comprise voice information carried over the wireless signal in the form of data packets. Typically, in such a wireless communication system, a decoder is used at the receiving end to decode the wireless signal for recovering the voice information. The decoder often incorporates error detection circuitry as well as error correction circuitry for detection and correction of data errors before conversion of the data packets into an audio signal that is used to drive a loudspeaker.

Traditional solutions for error detection and correction suffer from several shortcomings. For example, in one implementation, error detection and correction in the decoder is carried out by storing received data packets in a storage buffer. Upon detection of an error in an incoming data packet, the decoder replaces the defective data packet with a data packet that is generated by comparing the incoming defective data packet with the data packet stored in the storage buffer. The replacement of a defective packet is necessary so as to eliminate gaps in the data stream coming out of the decoder. Such gaps lead to unacceptable amplitude fluctuations in the audio signal routed to the speaker.

Unfortunately, the error-correction procedure described above proves inadequate when a series of incoming data packets contain errors. In this situation, the decoder may store a first defective data packet and subsequently use this defective data. The result produces an erroneously decoded data packet that may generate a highly undesirable noise pop in the loudspeaker. In certain instances, such a noise pop may not only cause discomfort to a listener but may also cause damage to the loudspeaker.

SUMMARY

This Summary is provided to introduce a selection of concepts in a simplified form that are further described below in the Detailed Description of Illustrative Embodiments. This Summary is not intended to identify key features or essential features of the claimed subject matter, nor is it intended to be used to limit the scope of the claimed subject matter.

In a first exemplary embodiment, an audio processing system includes a voice decoder and an audio processor. The voice decoder is configured to generate decoded voice data packets from a stream of incoming voice data packets carried in a wireless signal, the decoded voice data packets being operative to drive an audio transducer. The voice decoder compresses the voice samples to reduce the amount of bandwidth required to transport information over the wireless link. The audio processor, which is located on an output side of the voice decoder, is configured to disconnect the voice decoder from the audio transducer upon detecting an error in the stream of incoming voice data packets carried in the wireless signal. The audio processor is also configured to generate an amplitude scaled signal from a decoded error-free voice data packet and connect the amplitude scaled signal into the audio transducer.

In a second exemplary embodiment, a method for error management in an audio system incorporates decoding a stream of incoming voice data packets in a voice decoder. An audio transducer is then driven using decoded error-free voice data packets generated by the voice decoder. The method includes storing a decoded error-free voice data packet generated by the voice decoder, and disconnecting the voice decoder from the audio transducer upon detection of a first packet error in the stream of incoming voice data packets. Furthermore, the method includes connecting into the audio transducer, the stored decoded error-free voice data packet.

In a third exemplary embodiment, a computer-readable medium contains computer-executable instructions for executing error management in an audio system. The audio processing includes decoding a stream of incoming voice data packets in a voice decoder. An audio transducer is then driven using decoded error-free voice data packets generated by the voice decoder. The instructions are further directed towards storing a decoded error-free voice data packet generated by the voice decoder, and disconnecting the voice decoder from the audio transducer upon detection of a first packet error in the stream of incoming voice data packets. Furthermore, the instructions are further directed towards connecting into the audio transducer, the stored decoded error-free voice data packet.

Additional features and advantages will be made apparent from the following detailed description of illustrative embodiments that proceeds with reference to the accompanying drawings.

BRIEF DESCRIPTION OF THE DRAWINGS

The foregoing summary, as well as the following detailed description, is better understood when read in conjunction with the appended drawings. For the purpose of illustrating error management in an audio system, there is shown in the drawings exemplary constructions thereof, however, error management in an audio system is not limited to the specific methods and instrumentalities disclosed.

DETAILED DESCRIPTION OF ILLUSTRATIVE EMBODIMENTS

The following description uses a wireless gaming platform to illustrate an example error management in an audio system. However, one of ordinary skill in the art will recognize that error management in an audio system can be incorporated into a variety of other applications, including wired systems, optical systems, and smaller sub-systems and circuits.

Figure 1:
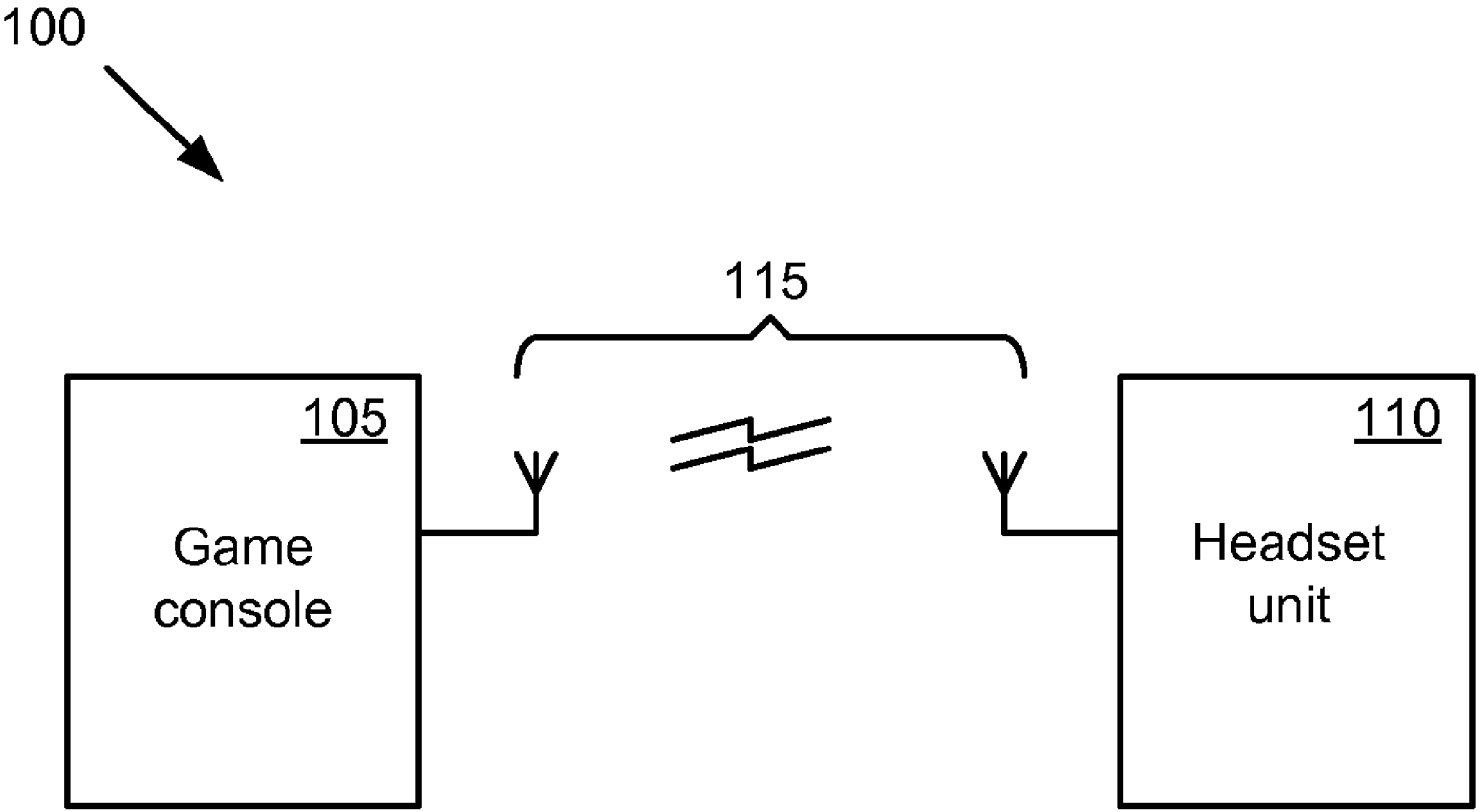
FIG. 1 is a block diagram of a wireless communication system in which the wireless audio system can be implemented.

FIG. 1 is a block diagram of a wireless communication system 100. Wireless communication system 100 includes a game console 105 and a headset unit 110. In one exemplary embodiment, game console 105 is a Microsoft Xbox 360® and the headset unit is a wireless headset communicatively coupled to game console 105. A wireless link 115 is used for carrying various signals such as communication, control and audio signals between game console 105 and headset unit 110. Of particular interest, are audio signals transmitted over wireless link 115 by game console 105 towards headset unit 110.

The audio signals are embedded in a wireless signal that is transmitted over wireless link 115 in a time division multiple access (TDMA) format incorporating frequency-hopping spread spectrum (FHSS) within the Industrial-Scientific-Medical (ISM) band centered around 2.4 GHz. The wireless signal is susceptible to RFI arising from a variety of sources such as cordless phones, remote control devices, and thunderstorms. Consequently, headset unit is outfitted with an audio processor that is used to detect packet errors and counter the effect of these errors upon the audible signals that are emitted by headset unit 110.

Figure 2:
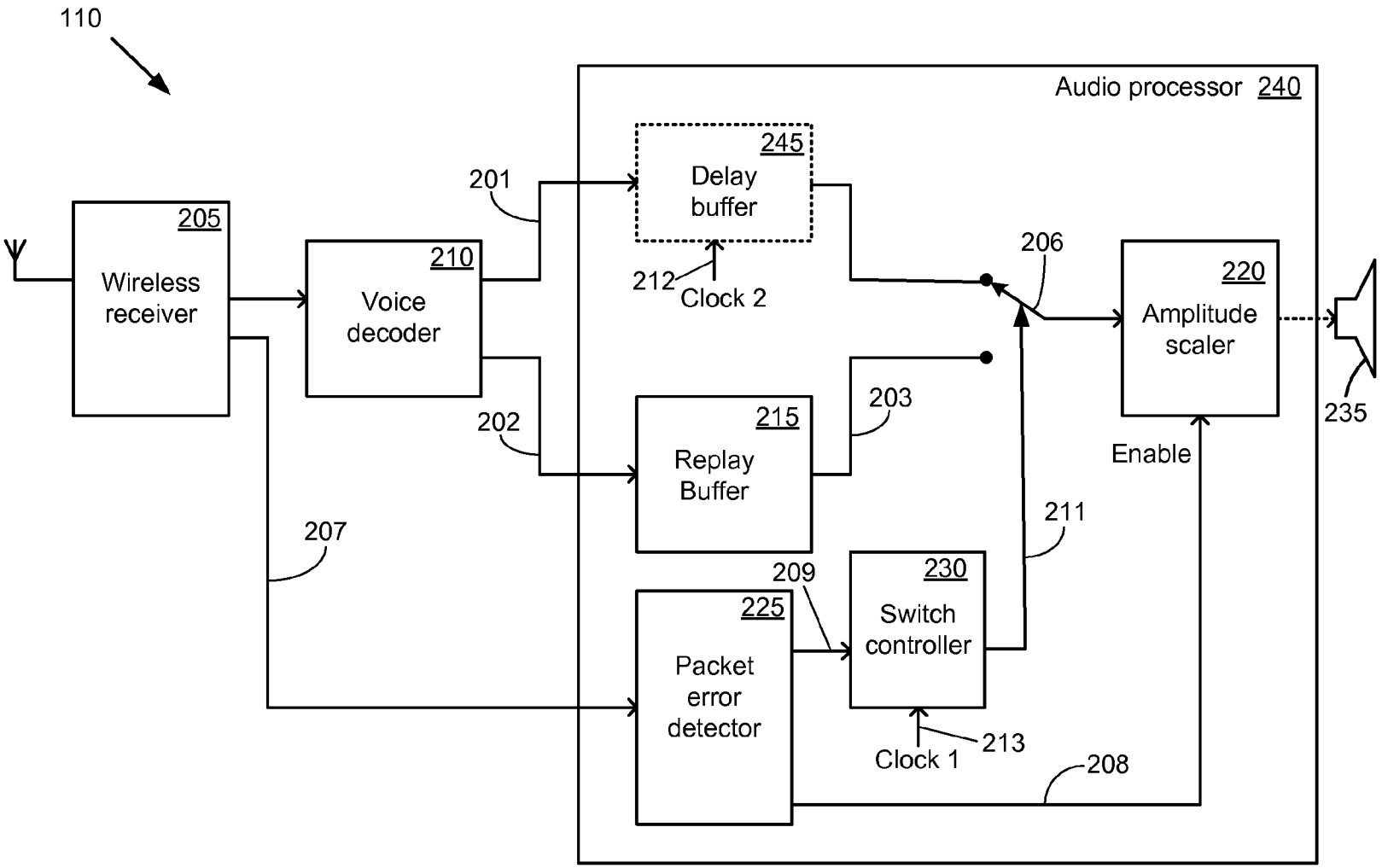
FIG. 2 is a block diagram showing elements of a headset unit that is a part of the wireless communication system of FIG. 1.

FIG. 2 is a block diagram showing some elements contained in headset unit 110. Wireless receiver 205 is a radio frequency (RF) front-end circuit that receives the wireless signal transmitted by game console 105 (not shown) and generates therefrom, a baseband digital signal containing voice information in the form of data packets. The baseband digital signal is coupled into voice decoder 210 where the packets are decoded using various decoding processes. For example, in one implementation, voice decoder 210 is a G.726 vocoder that uses an industry wide ADPCM standard specified by the International Telecommunication Standardization Sector (ITU-T). Any appropriate vocoder can be utilized. For example, in another implementation, voice decoder 210 is a μ-law and/or A-law vocoder that is also an industry-wide telephony standard for voice communications.

The decoded voice data packets generated by voice decoder 210 are coupled into audio processor 240, which is located on the output side of voice decoder 210, via two connections 201 and 202. First connection 202 is used for connecting voice decoder 210 to a replay buffer 215 contained in audio processor 240. Second connection 201 is used for connecting voice decoder 210 to a switch 206, which is also contained in audio processor 240. A delay buffer 245 may be optionally inserted into second connection 201 between voice decoder 210 and switch 206.

Replay buffer 215 provides temporary storage for the decoded voice data packets generated by voice decoder 210. In a first exemplary implementation, the temporary storage is carried out using a first-in-first-out (FIFO) data bit storage circuit. In a second exemplary implementation, the temporary storage is carried out using a circular data bit buffer in lieu of, or in combination with, the LIFO data bit storage circuit.

Switch 206 is a single-pole-double-throw (SPDT) switch which is operable to either route decoded voice data packets carried over connection 201 from voice decoder 210 or decoded voice data packets carried over connection 203 from replay buffer 215. The normally-closed position of switch 206 is selected so as to couple voice decoder 210 to amplitude scaler 220. Upon activating switch 206, voice decoder 210 is disconnected from amplitude scaler 220, and replay buffer 215 is connected to amplitude scaler 220 instead.

In alternative embodiments, switch configurations other than SPDT may be used. Furthermore, switch 206 may be implemented in a variety of ways. For example, switch 206 is a relay in a first implementation and an optical switch in a second implementation.

Amplitude scalar 220 provides a scaling function upon the audio signal carried in the voice data packets routed through switch 206. In a first exemplary implementation, amplitude scalar 220 provides amplitude scaling in an analog format upon an analog voice signal derived from a digital-to-analog converter (DAC) (not shown) that may be embedded inside amplitude scaler 220. This process may be accomplished by using a suitable signal attenuator or an amplifier.

In a second implementation, amplitude scalar 220 provides amplitude scaling in a digital format upon the digital voice data packets. This procedure may include the replacement and/or elimination of certain data bits. The modified digital data bits are routed to a DAC (either internal or external to audio scalar 220) for conversion from digital to analog format before coupling into an audio transducer 235. Audio transducer 235 is illustrative of a single speaker, or a pair of speakers of headset unit 110.

Packet error detector 225, which is also a component of audio processor 240, is coupled to wireless receiver 205 through a connection 207 over which wireless receiver 205 provides to packet error detector 225, the baseband digital signal containing voice information in the form of data packets. Packet error detector 225 produces two output signals. The first output signal is a trigger signal that is carried over connection 209 to a switch controller 230, which uses this trigger signal to generate a switch control signal for activating switch 206. The second output signal is an enable signal that is carried over connection 208 to amplitude scaler 220. The enable signal is a variable width pulse signal in a first exemplary implementation, a variable voltage level in a second exemplary implementation, and a digital code word in a third exemplary implementation.

Operation of headset unit 110 of FIG. 2 will now be described in further detail. The baseband digital signal generated by wireless receiver 205 constitutes a stream of incoming voice data packets containing error-free voice data packets as well as data packets that may have suffered errors during wireless transmission. The stream of incoming voice data packets is coupled into voice decoder 210 where decoding and error correction is carried out. Error-free decoded voice packets are coupled to amplitude scaler 220 through switch 206. Amplitude scaler 220 is configured to provide unity gain upon the voice signals carried in the error-free decoded voice packets. In alternative implementations, amplitude scaler 220 is configured to provide a positive gain or an attenuation upon voice signals carried in the error-free decoded voice packets.

The error correction process of voice decoder 210 depends upon the type of device selected for implementing voice decoder 210. For example, in one correction process, upon detection of a voice data packet containing an error, voice decoder 210 replaces the errored voice data packet with an error-free voice data packet that was received just prior to the detection of the errored voice data packet. In another correction process, upon detection of a voice data packet containing an error, voice decoder 210 modifies the bit pattern of the errored voice data packet in an effort to rectify the error. Unfortunately, these error correction processes do not provide a satisfactory solution for overcoming resultant noise perturbations, such as loud noise pops, that are produced in audio transducer 235.

To overcome this shortcoming, switch 206 is operative to disconnect voice decoder 210 from audio transducer 235 whenever a first errored voice data packet is detected in the stream of incoming voice data packets. This process is carried out by activating switch 206 using the switch control signal (described above) generated by packet error detector 225 and carried over connection 211. When activated in this manner, switch 206 couples replay buffer 215 to amplitude scaler 220. Replay buffer 215 contains error-free decoded voice data packets that had been received prior to the detection of the errored voice data packet. The last error-free decoded voice packet is transmitted via switch 206 into amplitude scaler 220. Amplitude scaler 220 generates one or more amplitude scaled signals by using a scaling factor upon the amplitude of the voice signal contained in the error-free decoded voice packet. For example, a first scaled down signal is generated using a scaling factor that is selected to be a percentage value reduction in amplitude of the voice signal contained in the error-free decoded voice packet factor.

The enable signal as well as the switch control signal revert to their inactive states if packet error detector 225 does not detect a second errored voice data packet immediately following the first errored voice data packet. Under this condition, switch 206 reverts to its normally-closed position thereby coupling subsequent error-free voice data packets to flow from voice decoder 210 and propagate through amplitude scaler 220 without any scaling down. However, if packet error detector 225 does indeed detect a second errored voice data packet immediately following the first errored voice data packet, switch 206 remains in an activated state, thereby connecting the last error-free decoded voice packet stored in replay buffer 215 into amplitude scaler 220. Amplitude scaler 220 generates a second scaled down signal by scaling down the amplitude of the voice signal contained in the error-free decoded voice packet by a second scaling factor. For example, if the first scaling factor is selected to be a 20% reduction in amplitude in the error-free decoded voice packet factor, the second scaling factor is selected to be a 40% reduction in amplitude of the voice signal contained in the error-free decoded voice packet factor.

As can be understood, the scaling factor is monotonically changed for each subsequent scaling operation. Consequently, in this example, the scaling process uses 20% reduction steps to bring the amplitude of the replacement signal down to zero after five successive scaling down operations.

The scaling factor can be set in various ways through hardware as well as software. In a first exemplary implementation, the scaling factor is set in firmware and the scaling down operation is carried out inside a computing environment, which is described below in more detail. In a second exemplary implementation, the scaling factor is carried out using hardware, for example by setting the characteristic of the enable signal carried over connection 208. For example, if the enable signal has a first pulse width, the scaling factor is set to a first value; and if the enable signal has a different pulse width, the scaling factor is set to a different value. In another exemplary implementation, the scaling factor is carried out in a pre-selected, monotonic pattern that is used in the presence of the enable signal irrespective of the characteristic of the enable signal.

As described above, switch 206 reverts to its normally-closed position if packet error detector 225 does not detect a second errored voice data packet immediately following the first errored voice data packet. This operation results in allowing error-free voice data packets to flow from voice decoder 210 and propagate through amplitude scaler 220 with unity gain. If packet error detector 225 detects a second errored voice data packet, the second scaling down operation (40% reduction in the above-described exemplary implementation) is carried out. For purposes of illustration, let it be assumed that the second errored voice data packet is now followed by an error-free voice data packet. Under this condition, switch 206 reverts to its normally-closed position. However, because the previous sound signal reproduced in audio transducer 235 is at a 40% reduction level, it would be undesirable to directly connect an error-free decoded voice data packet that may, potentially, have a large signal amplitude and cause a noise pop in audio transducer 235.

Consequently, a first replacement signal is generated from the last error-free decoded voice packet stored in delay buffer 245. Delay buffer 245 may be implemented in the form of a serial data shifter to provide temporary storage for decoded voice data packets generated by voice decoder 210. The amplitude of the first replacement signal is suitably selected so as to minimize any noise perturbation in audio transducer 235. For example, the first replacement signal may be selected to have a 20% reduction in amplitude of the voice signal contained in the error-free decoded voice packet factor temporarily stored in delay buffer 245. After transmission of the first replacement signal from delay buffer 245 via switch 206 to amplitude scaler 220 (wherein the 20% reduction may be carried out), a second replacement signal is generated (assuming that the incoming stream of voice data packets into voice decoder 210 is still error-free). The second replacement signal is generated by a scaling up operation carried out in amplitude scaler 220. In this example, amplitude scaler 220 may be set to unity gain for scaling up the first replacement signal from its 20% reduced level.

It will be understood, the scaling factor is monotonically changed for each subsequent scaling up operation. Consequently, in this example, the scaling up process may use 20% incremental steps to monotonically raise the amplitude of the replacement signal from a reference level. While the reference level described above pertains to the last error-free decoded voice packet factor temporarily stored in delay buffer 245, in other embodiments, an absolute amplitude value (e.g. zero) stored in a register (not shown) may be used instead.

It will be further understood, that the scaling process (reduction as well as incrementing) may incorporate one of several alternative patterns. Specifically, while the example above used discrete 20% steps, in other implementations other step values may be used. Furthermore, in place of discrete steps, the scaling pattern may correspond to one or more of a variety of linear and non-linear formats. A non-linear format may be selected for example, to accommodate a wide variance in amplitudes of the voice signal contained in the voice data packets. A non-exhaustive list of such non-linear formats includes: a μ-law format, an A-law format, and a logarithmic progression format.

Attention is drawn to switch controller 230 and delay buffer 245 for purposes of describing additional particulars. Specifically, with reference to switch controller 206, attention is drawn to clock 1 that is carried over connection 213. Clock 2 (as well as clock 1) is derived from a master system clock (not shown). Switch controller 206 utilizes clock 2 to generate a clock-synchronized switch control signal for activating switch 206. The switch control signal is synchronized so as to activate switch 206 at pre-selected times. For example, one pre-selected time corresponds to a frame boundary in the stream of voice data packets entering voice decoder 210. The frame boundary may be located at the boundaries of a byte, a nibble, or a packet of a certain length.

Delay buffer 245, which uses clock 1, provides a suitable delay for carrying out packet error detection in packet error detector 225 and generation of the switch control signal in switch controller 230. The delay is selected so as to avoid loss or corruption of voice data packets when switch 206 is operated. In one case, the delay corresponds to one frame in the stream of voice data packets entering voice decoder 210. The process of providing a delay using a clock such as clock 2, is known in the art and will not be elaborated upon herein.

Figure 3:
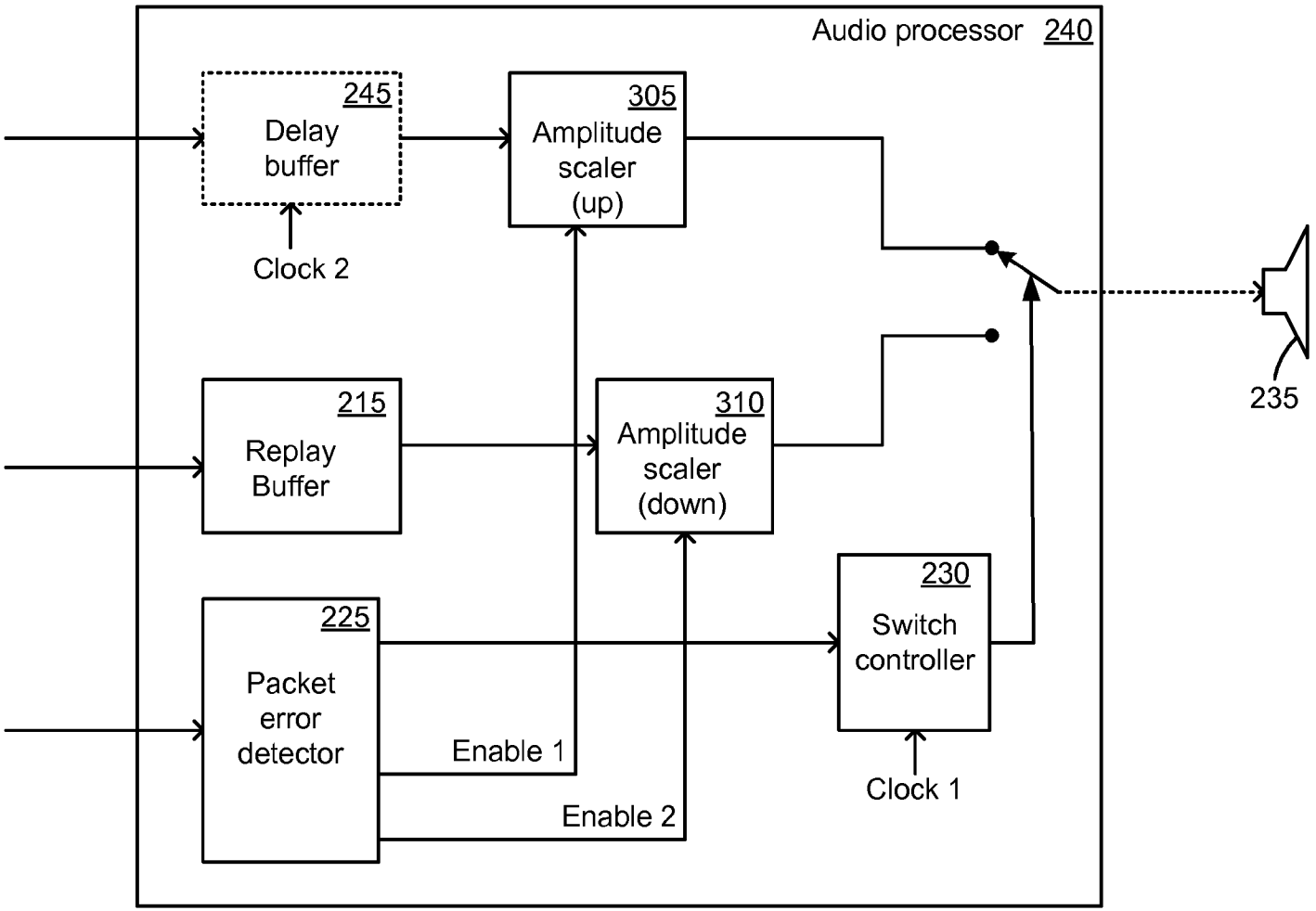
FIG. 3 is a block diagram of an exemplary embodiment of an audio processor contained in the headset unit of FIG. 2.

FIG. 3 is a block diagram illustrating an alternative embodiment of audio processor 240 that is a part of headset unit 110 illustrated in FIG. 2. In this alternative embodiment, the single amplitude scaler 220 is replaced by two separate amplitude scalers—amplitude scaler 305 and amplitude scaler 310. Amplitude scaler 305 is used for generating the replacement signals incorporating scaling up and/or scaling down operations carried out upon the last error-free decoded voice packet stored in delay buffer 245. Amplitude scaler 310 is used for generating the scaled down signals using the last error-free decoded voice packet stored in replay buffer 215.

Figure 4:
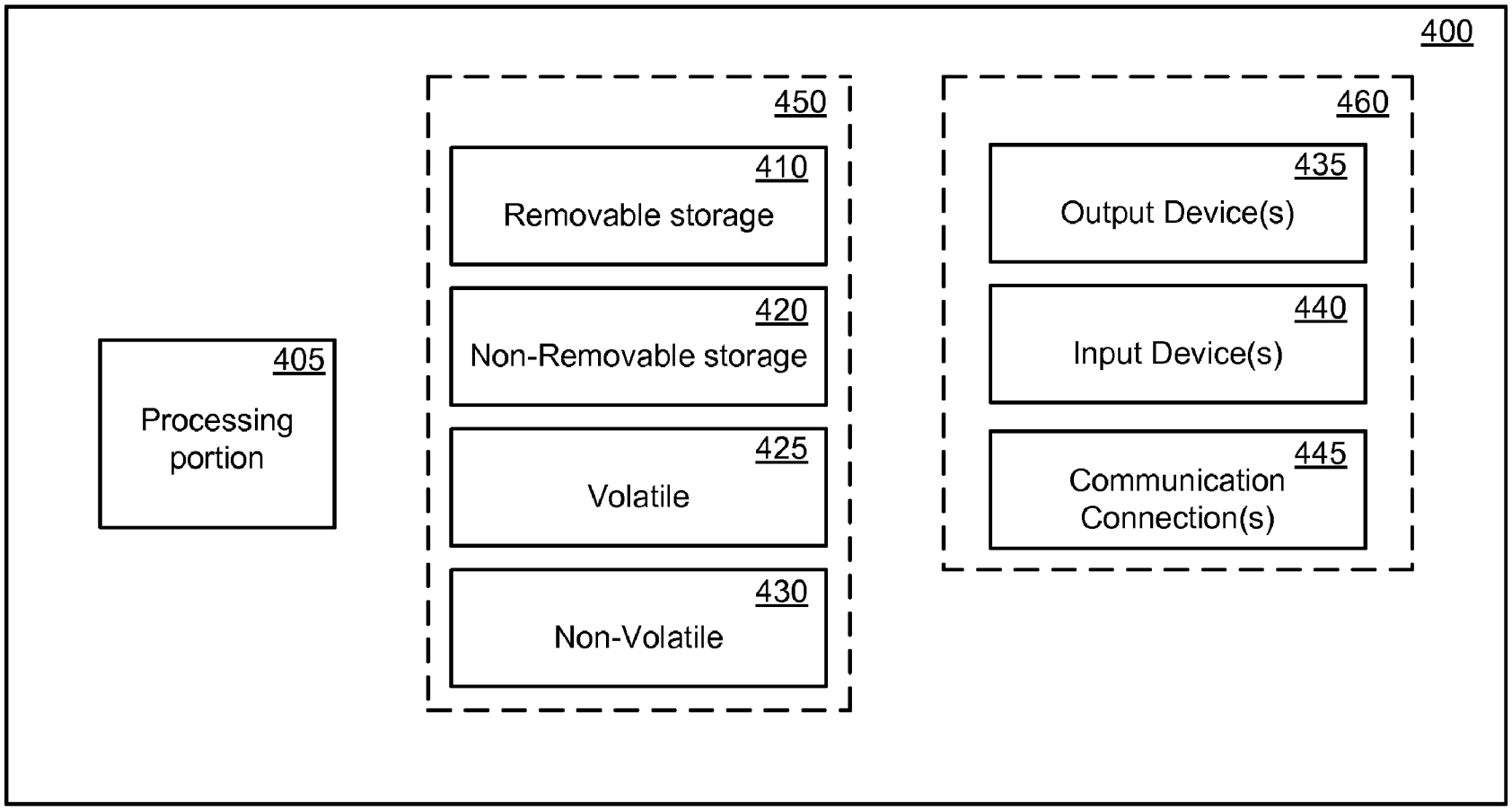
FIG. 4 is a block diagram of a generic communication element for implementing the audio processor.

Many of the functions embodied in communication system 100, for example the audio processor 240, may be implemented using various hardware, software, and firmware platforms. FIG. 4 illustrates one such exemplary platform implemented on a processor 400. The processor 400 comprises a processing portion 405, a memory portion 450, and an input/output portion 460. The processing portion 405, memory portion 450, and input/output portion 460 are coupled together (coupling not shown in FIG. 4) to allow communications therebetween. The input/output portion 460 is capable of providing and/or receiving components utilized to perform error management in an audio system as described above. For example, the input/output portion 460 is capable of, as described above, providing the switch control signal, the enable signal, and other control signals.

The processing portion 405 is capable of implementing error management in an audio system as described above. For example, the processing portion 405 is capable of checking the incoming stream of voice data packets to determine error conditions using a cyclic redundancy check (CRC), and for determining one or more scaling factors in real-time or in non real-time modes of operation.

The processor 400 can be implemented as a client processor and/or a server processor. In a basic configuration, the processor 400 can include at least one processing portion 405 and memory portion 450. The memory portion 450 can store any information utilized in conjunction with error management in an audio system. Depending upon the exact configuration and type of processor, the memory portion 450 can be volatile (such as RAM) 425, non-volatile (such as ROM, flash memory, etc.) 430, or a combination thereof. The processor 400 can have additional features/functionality. For example, the processor 400 can include additional storage (removable storage 410 and/or non-removable storage 420) including, but not limited to, magnetic or optical disks, tape, flash, smart cards or a combination thereof. Computer storage media, such as memory portion 450, 425, 430, 410, and 420, include volatile and nonvolatile, removable and non-removable media implemented in any method or technology for storage of information such as computer readable instructions, data structures, program modules, or other data. Computer storage media include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, universal serial bus (USB) compatible memory, smart cards, or any other medium which can be used to store the desired information and which can be accessed by the processor 400. Any such computer storage media can be part of the processor 400.

The processor 400 can also contain communications connection(s) 445 that allow the processor 400 to communicate with other devices. Communications connection(s) 445 is an example of communication media. Communication media typically embody computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. The term computer readable media as used herein includes both storage media and communication media. The processor 400 also can have input device(s) 440 such as keyboard, mouse, pen, voice input device, touch input device, etc. Output device(s) 435 such as a display, speakers, printer, etc. also can be included.

Figure 5:
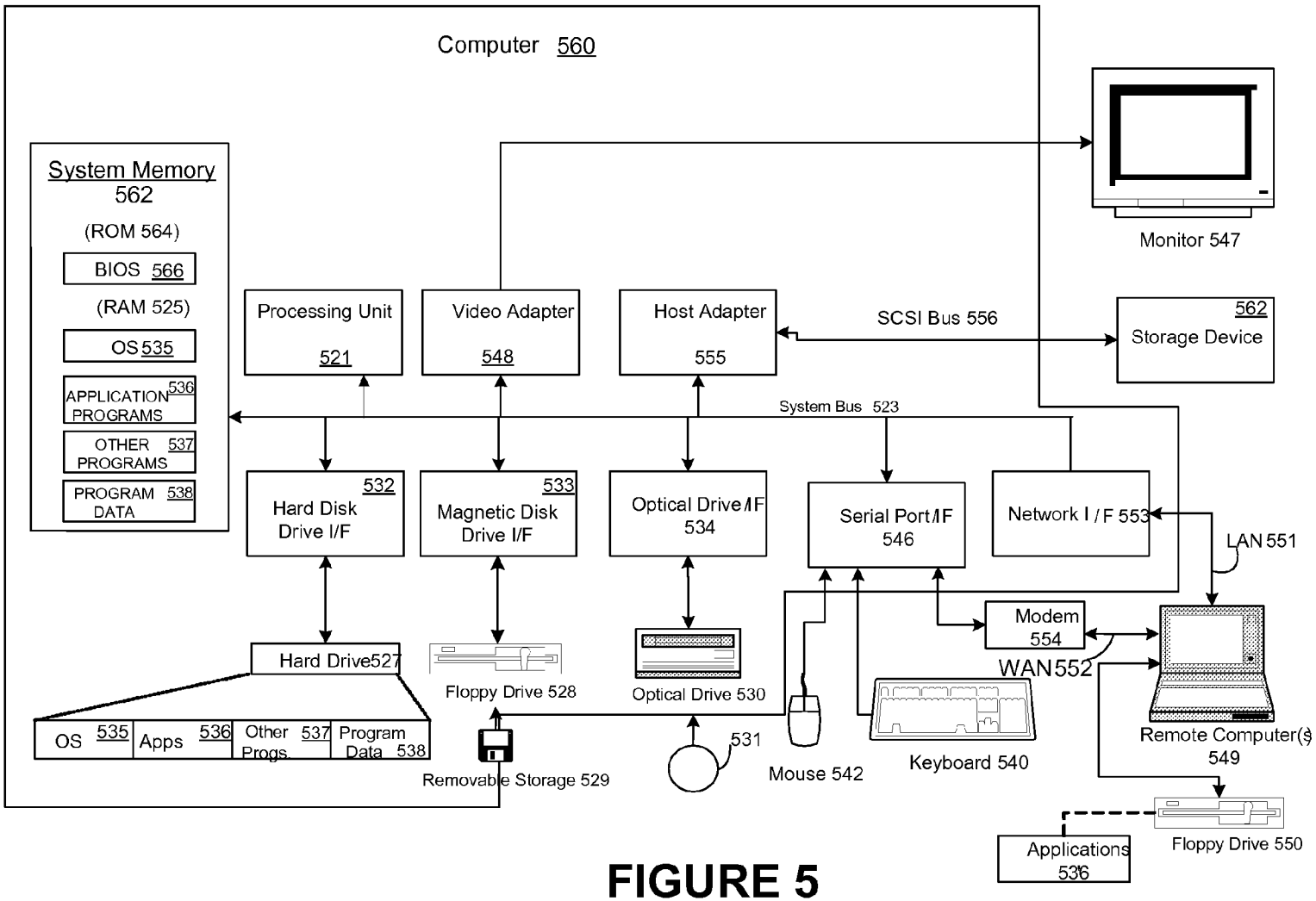
FIG. 5 is a depiction of a suitable computing environment in which error management in an audio system can be implemented.

FIG. 5 and the following discussion provide a brief general description of a suitable computing environment in which error management in an audio system can be implemented. The computing environment of FIG. 5 is not limited to communications system 100 shown in FIG. 1. For example, the computing environment of FIG. 5 may represent a geographically dispersed telecommunication system that includes a wireless transmitter at a cell phone base station and a cell phone receiver incorporating the audio processor described above. Although not required, various aspects of error management in an audio system can be described in the general context of computer executable instructions, such as program modules, being executed by a computer, such as a client workstation or a server. Generally, program modules include routines, programs, objects, components, data structures and the like that perform particular tasks or implement particular abstract data types. Moreover, implementation of error management in an audio system can be practiced with other computer system configurations, including hand held devices, multi processor systems, microprocessor based or programmable consumer electronics, network PCs, minicomputers, mainframe computers, and the like. Further, error management in an audio system also can be practiced in distributed computing environments where tasks are performed by remote processing devices that are linked through a communications network. In a distributed computing environment, program modules can be located in both local and remote memory storage devices.

A computer system can be roughly divided into three component groups: the hardware component, the hardware/software interface system component, and the applications programs component (also referred to as the "user component" or "software component"). In various embodiments of a computer system the hardware component may comprise the central processing unit (CPU) 521, the memory (both ROM 564 and RAM 525), the basic input/output system (BIOS) 566, and various input/output (I/O) devices such as a keyboard 540, a mouse 562, a monitor 547, and/or a printer (not shown), among other things. The hardware component comprises the basic physical infrastructure for the computer system.

The applications programs component comprises various software programs including but not limited to compilers, database systems, word processors, business programs, videogames, and so forth. Application programs provide the means by which computer resources are utilized to solve problems, provide solutions, and process data for various users (machines, other computer systems, and/or end-users). In an example embodiment, application programs perform the functions associated with error management in an audio system as described above.

The hardware/software interface system component comprises (and, in some embodiments, may solely consist of) an operating system that itself comprises, in most cases, a shell and a kernel. An "operating system" (OS) is a special program that acts as an intermediary between application programs and computer hardware. The hardware/software interface system component may also comprise a virtual machine manager (VMM), a Common Language Runtime (CLR) or its functional equivalent, a Java Virtual Machine (JVM) or its functional equivalent, or other such software components in the place of or in addition to the operating system in a computer system. A purpose of a hardware/software interface system is to provide an environment in which a user can execute application programs.

The hardware/software interface system is generally loaded into a computer system at startup and thereafter manages all of the application programs in the computer system. The application programs interact with the hardware/software interface system by requesting services via an application program interface (API). Some application programs enable end-users to interact with the hardware/software interface system via a user interface such as a command language or a graphical user interface (GUI).

A hardware/software interface system traditionally performs a variety of services for applications. In a multitasking hardware/software interface system where multiple programs may be running at the same time, the hardware/software interface system determines which applications should run in what order and how much time should be allowed for each application before switching to another application for a turn. The hardware/software interface system also manages the sharing of internal memory among multiple applications, and handles input and output to and from attached hardware devices such as hard disks, printers, and dial-up ports. The hardware/software interface system also sends messages to each application (and, in certain case, to the end-user) regarding the status of operations and any errors that may have occurred. The hardware/software interface system can also offload the management of batch jobs (e.g., printing) so that the initiating application is freed from this work and can resume other processing and/or operations. On computers that can provide parallel processing, a hardware/software interface system also manages dividing a program so that it runs on more than one processor at a time.

A hardware/software interface system shell (referred to as a "shell") is an interactive end-user interface to a hardware/software interface system. (A shell may also be referred to as a "command interpreter" or, in an operating system, as an "operating system shell"). A shell is the outer layer of a hardware/software interface system that is directly accessible by application programs and/or end-users. In contrast to a shell, a kernel is a hardware/software interface system's innermost layer that interacts directly with the hardware components.

As shown in FIG. 5, an exemplary general purpose computing system includes a conventional computing device 560 or the like, including a processing unit 521, a system memory 562, and a system bus 523 that couples various system components including the system memory to the processing unit 521. The system bus 523 may be any of several types of bus structures including a memory bus or memory controller, a peripheral bus, and a local bus using any of a variety of bus architectures. The system memory includes read only memory (ROM) 564 and random access memory (RAM) 525. A basic input/output system 566 (BIOS), containing basic routines that help to transfer information between elements within the computing device 560, such as during start up, is stored in ROM 564. The computing device 560 may further include a hard disk drive 527 for reading from and writing to a hard disk (hard disk not shown), a magnetic disk drive 528 (e.g., floppy drive) for reading from or writing to a removable magnetic disk 529 (e.g., floppy disk, removal storage), and an optical disk drive 530 for reading from or writing to a removable optical disk 531 such as a CD ROM or other optical media. The hard disk drive 527, magnetic disk drive 528, and optical disk drive 530 are connected to the system bus 523 by a hard disk drive interface 532, a magnetic disk drive interface 533, and an optical drive interface 534, respectively. The drives and their associated computer readable media provide non volatile storage of computer readable instructions, data structures, program modules and other data for the computing device 560. Although the exemplary environment described herein employs a hard disk, a removable magnetic disk 529, and a removable optical disk 531, it should be appreciated by those skilled in the art that other types of computer readable media which can store data that is accessible by a computer, such as magnetic cassettes, flash memory cards, digital video disks, Bernoulli cartridges, random access memories (RAMs), read only memories (ROMs), and the like may also be used in the exemplary operating environment. Likewise, the exemplary environment may also include many types of monitoring devices such as heat sensors and security or fire alarm systems, and other sources of information.

A number of program modules can be stored on the hard disk, magnetic disk 529, optical disk 531, ROM 564, or RAM 525, including an operating system 535, one or more application programs 536, other program modules 537, and program data 538. A user may enter commands and information into the computing device 560 through input devices such as a keyboard 540 and pointing device 562 (e.g., mouse). Other input devices (not shown) may include a microphone, joystick, gaming pad, satellite disk, scanner, or the like. These and other input devices are often connected to the processing unit 521 through a serial port interface 546 that is coupled to the system bus, but may be connected by other interfaces, such as a parallel port, game port, or universal serial bus (USB). A monitor 547 or other type of display device is also connected to the system bus 523 via an interface, such as a video adapter 548. In addition to the monitor 547, computing devices typically include other peripheral output devices (not shown), such as speakers and printers. The exemplary environment of FIG. 6 also includes a host adapter 555, Small Computer System Interface (SCSI) bus 556, and an external storage device 562 connected to the SCSI bus 556.

The computing device 560 may operate in a networked environment using logical connections to one or more remote computers, such as a remote computer 549. The remote computer 549 may be another computing device (e.g., personal computer), a server, a router, a network PC, a peer device, or other common network node, and typically includes many or all of the elements described above relative to the computing device 560, although only a memory storage device 550 (floppy drive) has been illustrated in FIG. 5. The logical connections depicted in FIG. 5 include a local area network (LAN) 551 and a wide area network (WAN) 552. Such networking environments are commonplace in offices, enterprise wide computer networks, intranets and the Internet.

When used in a LAN networking environment, the computing device 560 is connected to the LAN 551 through a network interface or adapter 553. When used in a WAN networking environment, the computing device 560 can include a modem 554 or other means for establishing communications over the wide area network 552, such as the Internet. The modem 554, which may be internal or external, is connected to the system bus 523 via the serial port interface 546. In a networked environment, program modules depicted relative to the computing device 560, or portions thereof, may be stored in the remote memory storage device. It will be appreciated that the network connections shown are exemplary and other means of establishing a communications link between the computers may be used.

While it is envisioned that numerous embodiments of error management in an audio system are particularly well-suited for computerized systems, nothing in this document is intended to limit wireless error management in an audio system to such embodiments. On the contrary, as used herein the term "computer system" is intended to encompass any and all devices capable of storing and processing information and/or capable of using the stored information to control the behavior or execution of the device itself, regardless of whether such devices are electronic, mechanical, logical, or virtual in nature.

The various techniques described herein can be implemented in connection with hardware or software or, where appropriate, with a combination of both. Thus, the methods and apparatuses for error management in an audio system, or certain aspects or portions thereof, can take the form of program code (i.e., instructions) embodied in tangible media, such as floppy diskettes, CD-ROMs, hard drives, or any other machine-readable storage medium, wherein, when the program code is loaded into and executed by a machine, such as a computer, the machine becomes an apparatus for implementing error management in an audio system.

The program(s) can be implemented in assembly or machine language, if desired. In any case, the language can be a compiled or interpreted language, and combined with hardware implementations. The methods and apparatuses for implementing error management in an audio system also can be practiced via communications embodied in the form of program code that is transmitted over some transmission medium, such as over electrical wiring or cabling, through fiber optics, or via any other form of transmission, wherein, when the program code is received and loaded into and executed by a machine, such as an EPROM, a gate array, a programmable logic device (PLD), a client computer, or the like. When implemented on a general-purpose processor, the program code combines with the processor to provide a unique apparatus that operates to invoke the functionality of error management in an audio system. Additionally, any storage techniques used in connection with error management in an audio system can invariably be a combination of hardware and software.

Figure 6:
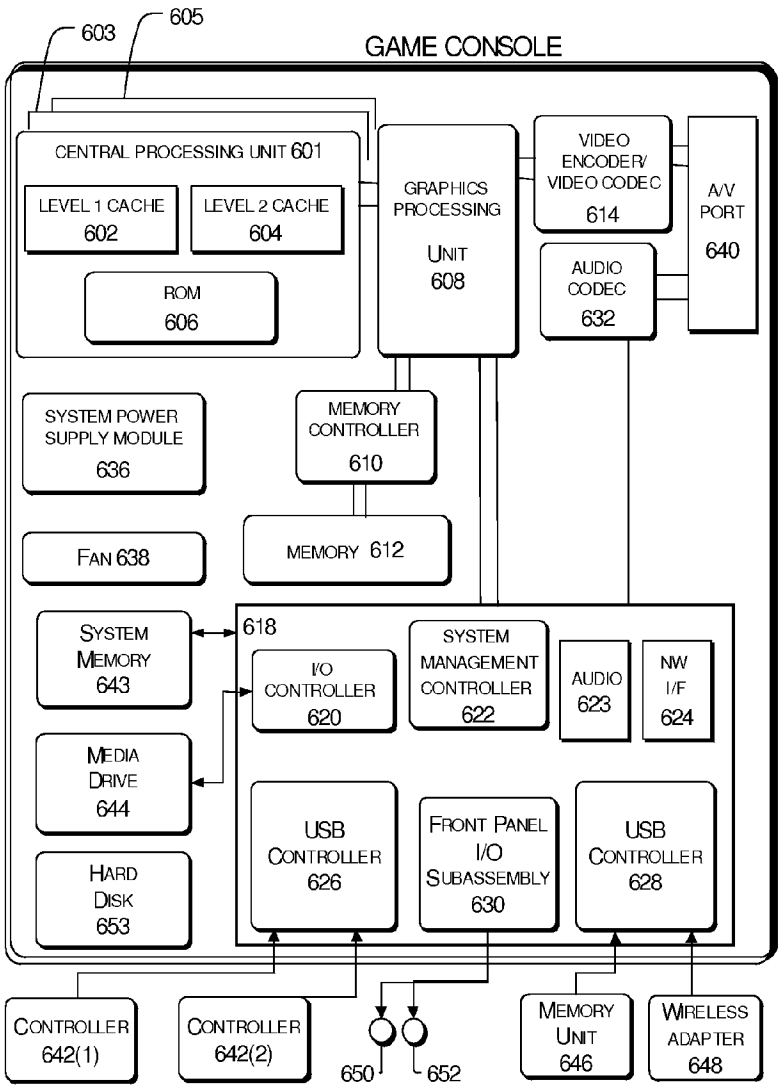
FIG. 6 is a depiction of a suitable computing environment in which a game console, which is a part of the communication system of FIG. 1, can be implemented.

FIG. 6 is a block diagram of an exemplary implementation of game console 105 shown in FIG. 1. Game console 105 along with other devices described herein, such as headset unit 110, are capable of performing the functions needed to accomplish wireless communication as described above. A typical game console comprises hardware and software that are specifically designed to support a core set of usage scenarios.

Game console 105 has a central processing unit (CPU) 601 having a level 1 (L1) cache 602, a level 2 (L2) cache 604, and a flash ROM (Read-only Memory) 606. The level 1 cache 602 and level 2 cache 604 temporarily store data and hence reduce the number of memory access cycles, thereby improving processing speed and throughput. The flash ROM 606 can store executable code that is loaded during an initial phase of a boot process when the game console 105 is initially powered. Alternatively, the executable code that is loaded during the initial boot phase can be stored in a FLASH memory device (not shown). Further, ROM 606 can be located separate from CPU 601. Game console 105 can, optionally, be a multi-processor system; for example game console 105 can have three processors 601, 603, and 605, where processors 603 and 605 have similar or identical components to processor 601.

A graphics processing unit (GPU) 608 and a video encoder/video codec (coder/decoder) 614 form a video processing pipeline for high speed and high resolution graphics processing. Data is carried from the graphics processing unit 608 to the video encoder/video codec 614 via a bus. The video processing pipeline outputs data to an A/V (audio/video) port 640 for transmission to a television or other display device. A memory controller 610 is connected to the GPU 608 and CPU 601 to facilitate processor access to various types of memory 612, such as, but not limited to, a RAM (Random Access Memory).

Game console 105 includes an I/O controller 620, a system management controller 622, an audio processing unit 623, a network interface controller 624, a first USB host controller 626, a second USB controller 628 and a front panel I/O subassembly 630 that may be implemented on a module 618. The USB controllers 626 and 628 serve as hosts for peripheral controllers 642(1)-842(2), a wireless adapter 648, and an external memory unit 646 (e.g., flash memory, external CD/DVD ROM drive, removable media, etc.). The network interface 624 and/or wireless adapter 648 provide access to a network (e.g., the Internet, home network, etc.) and may be any of a wide variety of various wired or wireless interface components including an Ethernet card, a modem, a Bluetooth module, a cable modem, and the like.

System memory 643 is provided to store application data that is loaded during the boot process. A media drive 644 is provided and may comprise a DVD/CD drive, hard drive, or other removable media drive, etc. The media drive 644 may be internal or external to the game console 105. When media drive 644 is a drive or reader for removable media (such as removable optical disks, or flash cartridges), then media drive 644 is an example of an interface onto which (or into which) media are mountable for reading. Application data may be accessed via the media drive 644 for execution, playback, etc. by game console 105. Media drive 644 is connected to the I/O controller 620 via a bus, such as a Serial ATA bus or other high speed connection (e.g., IEEE 5394). While media drive 644 may generally refer to various storage embodiments (e.g., hard disk, removable optical disk drive, etc.), game console 105 may specifically include a hard disk 652, which can be used to store gaming data, application data, or other types of data, and on which the file systems depicted in FIGS. 5 and 4 may be implemented.

The system management controller 622 provides a variety of service functions related to assuring availability of the game console 105. The audio processing unit 623 and an audio codec 632 form a corresponding audio processing pipeline with high fidelity, 5D, surround, and stereo audio processing according to aspects of the present subject matter described herein. Audio data is carried between the audio processing unit 623 and the audio codec 626 via a communication link. The audio processing pipeline outputs data to the A/V port 640 for reproduction by an external audio player or device having audio capabilities.

The front panel I/O subassembly 630 supports the functionality of the power button 650 and the eject button 652, as well as any LEDs (light emitting diodes) or other indicators exposed on the outer surface of the game console 105. A system power supply module 636 provides power to the components of the game console 105. A fan 638 cools the circuitry within the game console 105.

The CPU 601, GPU 608, memory controller 610, and various other components within the game console 105 are interconnected via one or more buses, including serial and parallel buses, a memory bus, a peripheral bus, and a processor or local bus using any of a variety of bus architectures.

When the game console 105 is powered on or rebooted, application data can be loaded from the system memory 643 into memory 612 and/or caches 602, 604 and executed on the CPU 601. The application can present a graphical user interface that provides a consistent user experience when navigating to different media types available on the game console 105. In operation, applications and/or other media contained within the media drive 644 may be launched or played from the media drive 644 to provide additional functionalities to the game console 105.

The game console 105 may be operated as a standalone system by simply connecting the system to a television or other display. In this standalone mode, the game console 105 may allow one or more users to interact with the system, watch movies, listen to music, and the like. However, with the integration of broadband connectivity made available through the network interface 624 or the wireless adapter 648, the game console 105 may further be operated as a participant in a larger network community.

Figure 7:
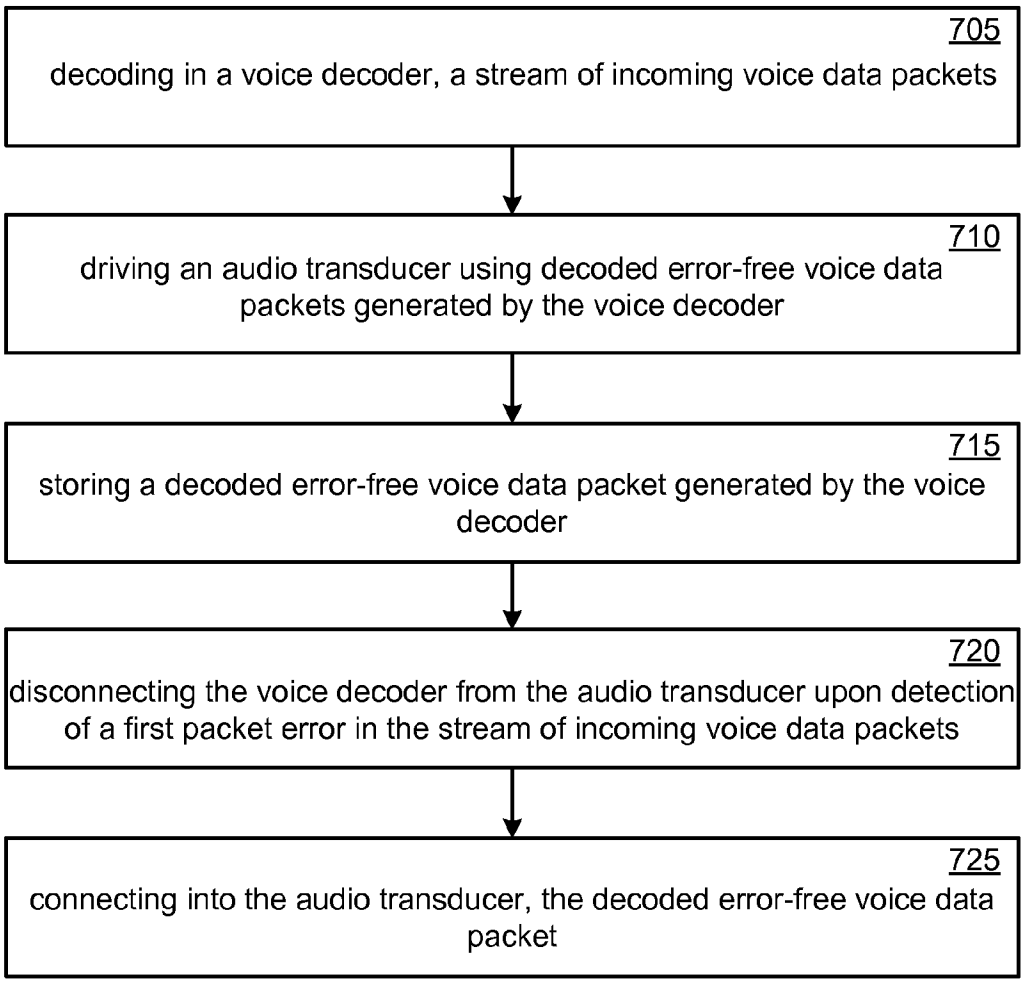
FIG. 7 depicts a flowchart of an exemplary method for error management in an audio system.

FIG. 7 discloses a flowchart for an exemplary method of error management in an audio system. In block 705, a voice decoder is used for decoding a stream of incoming voice data packets. In block 710, decoded error-free voice data packets generated by the voice decoder are used for driving an audio transducer. In block 715, one or more decoded error-free voice data packets are stored. In block 720, the voice decoder is disconnected from the audio transducer when a first packet error is detected in the stream of incoming voice packets. In block 725, one or more of the stored, decoded error-free voice data packets are used for driving the audio transducer. In an alternative embodiment, the stored, decoded error-free voice data packets are scaled in amplitude before being used to drive the audio transducer.

While error management in an audio system has been described in connection with the example embodiments of the various figures, it is to be understood that other similar embodiments can be used or modifications and additions can be made to the described embodiments for performing the same functions of error management in an audio system without deviating therefrom. Therefore, error management in an audio system as described herein should not be limited to any single embodiment, but rather should be construed in breadth and scope in accordance with the appended claims.

What is claimed:

1. An audio processing system, comprising:

a voice decoder configured to generate decoded voice data packets from a stream of incoming voice data packets; and an audio processor coupled to the voice decoder, the audio processor configured to:

store an error-free decoded voice data packet generated by the voice decoder;

generate a trigger signal upon detection of an error in the stream of incoming voice data packets;

generate from the trigger signal, a switch control signal;

provide a first delay upon decoded voice data packets received from the voice decoder, the first delay selected to accommodate processing delays incurred during generation of the trigger signal and the switch control signal; and transmit an output signal generated from one of: the stored error-free decoded voice data packet, or the decoded voice data packets that have undergone the first delay, wherein:

when the switch control signal is absent, the delayed stream of incoming voice data packets is connected to an amplitude scaler; and when the switch control signal is present, the delayed stream of incoming voice data packets is disconnected and the decoded error-free voice data packet is connected to the amplitude scaler.

2. The audio processing system of claim 1, wherein the voice decoder and the audio processor are contained in a headset unit communicatively coupled to a game console configured for transmitting the wireless signal carrying voice data packets.

3. The audio processing system of claim 1, wherein the audio processor comprises:

a switch operable to select the one of: the stored error-free decoded voice data packet, or the decoded voice data packets that have undergone the first delay;

a switch controller configured to receive a first clock signal for synchronously generating the switch control signal to operate the switch at a pre-selected time and a delay buffer configured to receive a second clock signal for synchronously providing the first delay upon the decoded voice data packets received from the voice decoder, wherein the first and second clock signals are both derived from a master clock, and wherein the pre-selected time is selected to avoid data corruption when the switch is activated by the switch control signal.

4. The audio processing system of claim 1, wherein the audio processor comprises:

a replay buffer for storing the error-free decoded voice data packet generated by the voice decoder.

5. A method for audio processing, the method comprising:

decoding in a voice decoder, a stream of incoming voice data packets;

storing a decoded error-free voice data packet generated by the voice decoder;

generating a trigger signal upon detecting a first data packet error in the stream of incoming voice data packets;

generating a switch control signal from the trigger signal;

routing the stream of incoming voice data packets through a delay buffer that is configured to provide a delay corresponding to a processing time required to generate the switch control signal;

when the switch control signal is absent, connecting the delayed stream of incoming voice data packets to an amplitude scaler; and when the switch control signal is present, disconnecting the delayed stream of incoming voice data packets and instead connecting the decoded error-free voice data packet to the amplitude scaler.

6. The method of claim 5, further comprising:

detecting a second data packet error in the stream of incoming voice data packets;

retaining the disconnect of the delayed stream of incoming voice data packets to the amplitude scaler;

generating in the amplitude scaler, a first scaled down signal from the decoded error-free voice data packet; and connecting the first scaled down signal into an audio transducer.

7. The method of claim 6, further comprising:

detecting a third data packet error in the stream of incoming voice data packets;

retaining the disconnect of the delayed stream of incoming voice data packets to the amplitude scaler;

generating in the amplitude scaler, a second scaled down signal from the decoded error-free voice data packet; and connecting the second scaled down signal into the audio transducer.

8. The method of claim 7, wherein the first, second, and subsequent scaled down signals are monotonically reduced in amplitude, respectively.

9. The method of claim 8, wherein the monotonic reduction comprises discrete amplitude steps based on a percentage value of a signal amplitude of the stored decoded error-free voice data packet.

10. The method of claim 7, further comprising:

detecting a first error-free voice data packet in the stream of incoming voice data packets;

generating a first replacement signal from the stored decoded error-free voice data packet; and connecting the first replacement signal into the audio transducer.

11. The method of claim 10, further comprising:

detecting a second error-free voice data packet in the stream of incoming voice data packets;

generating a second replacement signal from the stored decoded error-free voice data packet; and connecting the second replacement signal into the audio transducer.

12. The method of claim 11, wherein the first, second, and subsequent replacement signals are monotonically increasing in amplitude respectively.

13. The method of claim 12, wherein the monotonic increase comprises discrete amplitude steps based on a percentage value of a signal amplitude of the stored decoded error-free voice data packet.

14. The method of claim 11, further comprising:

detecting an $n^{th}$ error-free voice data packet in the stream of incoming voice data packets, wherein n is greater than or less than one; and reconnecting the delayed stream of incoming voice data packets to the amplitude scaler.

15. A computer-readable storage medium, wherein the computer-readable storage medium is not a signal, the computer-readable storage having stored thereon computer-executable instructions that when executed perform the steps of:

decoding a stream of voice data packets;

routing the stream of decoded voice data packets through a delay buffer configured to provide a delay based on a processing time required to generate a switch control signal;

storing an error-free voice data packet from amongst the stream of voice data packets;

generating a trigger signal upon detecting a first data packet error in the stream of voice data packets;

generating the switch control signal from the trigger signal;

when the switch control signal is absent, connecting the delayed stream of voice data packets from the delay buffer to an amplitude scaler; and when the switch control signal is present, disconnecting the delayed stream of voice data packets and instead connecting the decoded error-free voice data packet to the amplitude scaler.

* * * * *

UNITED STATES PATENT AND TRADEMARK OFFICE

CERTIFICATE OF CORRECTION

PATENT NO. : 7,827,030 B2
APPLICATION NO. : 11/763928
DATED : November 2, 2010
INVENTOR(S) : Smith et al.

It is certified that error appears in the above-identified patent and that said Letters Patent is hereby corrected as shown below:

In column 14, line 32, in Claim 3, after “time” insert -- ; --.

Signed and Sealed this
Tenth Day of May, 2011

David J. Kappos
*Director of the United States Patent and Trademark Office*